US006260009B1

(12) United States Patent
Dejaco

(10) Patent No.: US 6,260,009 B1
(45) Date of Patent: Jul. 10, 2001

(54) CELP-BASED TO CELP-BASED VOCODER PACKET TRANSLATION

(75) Inventor: Andrew P. Dejaco, San Diego, CA (US)

(73) Assignee: Qualcomm Incorporated, San Diego, CA (US)

( * ) Notice: Subject to any disclaimer, the term of this patent is extended or adjusted under 35 U.S.C. 154(b) by 0 days.

(21) Appl. No.: 09/249,060

(22) Filed: Feb. 12, 1999

(51) Int. Cl.[7] ..... G10L 21/00; G10L 21/04
(52) U.S. Cl. ..... 704/221; 704/203; 704/201
(58) Field of Search ..... 704/201–223

(56) References Cited

U.S. PATENT DOCUMENTS

| | | | | |
|---|---|---|---|---|
| 5,414,796 | | 5/1995 | Jacobs et al. | 395/2.3 |
| 5,497,396 | * | 3/1996 | Delprat | 375/220 |
| 5,995,923 | * | 11/1999 | Mermelstein et al. | 704/262 |
| 6,014,622 | * | 1/2000 | Su et al. | 704/219 |

FOREIGN PATENT DOCUMENTS

| | | | | |
|---|---|---|---|---|
| 0 138 073 | * | 9/1984 | (DE) | G10L/5/00 |
| 0751493 | | 1/1997 | (EP) . | |
| 0911807 | | 4/1999 | (EP) . | |
| 8-146997 | * | 11/1994 | (JP) | G10L/9/14 |
| 8146997 | | 6/1996 | (JP) . | |
| 9900791 | | 1/1999 | (WO) . | |

OTHER PUBLICATIONS

1986 IEEE Proc. ICASSP, "Adaptive Postfiltering of 16kb/s–ADPCM Speech", N. Jayant et al., pp. 829–832.

1987 IEEE, "Real–Time Vector APC Speech Coding at 4800 BPS With Adaptive Postfiltering", J. Chen et al., pp. 2181–2188.

1988 Proceedings of the Mobile Satellite Conference, "A 4.8 KBPS Code Excited Linear Predictive Coder," T. Tremain et al. pp. 491–496.

John Makhoul, "Linear Prediction: A Tutorial Review," Proceedings of the IEEE, vol. 63, No. 4, Apr. 1975. pp. 561–580.

* cited by examiner

*Primary Examiner*—Richemond Dorvil
*Assistant Examiner*—Daniel A. Nolan
(74) *Attorney, Agent, or Firm*—Thomas R. Rouse; Philip R. Wadsworth

(57) ABSTRACT

A method and apparatus for CELP-based to CELP-based vocoder packet translation. The apparatus includes a formant parameter translator and an excitation parameter translator. The formant parameter translator includes a model order converter and a time base converter. The method includes the steps of translating the formant filter coefficients of the input packet from the input CELP format to the output CELP format and translating the pitch and codebook parameters of the input speech packet from the input CELP format to the output CELP format. The step of translating the formant filter coefficients includes the steps of converting the model order of the formant filter coefficients from the model order of the input CELP format to the model order of the output CELP format and converting the time base of the resulting coefficients from the input CELP format time base to the output CELP format time base.

19 Claims, 11 Drawing Sheets

- - PRIOR ART - -

- -PRIOR ART- -

- -PRIOR ART- -

CELP-BASED TO CELP-BASED VOCODER PACKET TRANSLATION

BACKGROUND OF THE INVENTION

1. Field of the Invention

The present invention relates to code-excited linear prediction (CELP) speech processing. Specifically, the present invention relates to translating digital speech packets from one CELP format to another CELP format.

2. Related Art

Transmission of voice by digital techniques has become widespread, particularly in long distance and digital radio telephone applications. This, in turn, has created interest in determining the least amount of information which can be sent over the channel while maintaining the perceived quality of the reconstructed speech. If speech is transmitted by simply sampling and digitizing, a data rate on the order of 64 kilobits per second (kbps) is required to achieve a speech quality of a conventional analog telephone. However, through the use of speech analysis, followed by the appropriate coding, transmission, and resynthesis at the receiver, a significant reduction in the data rate can be achieved.

Devices which employ techniques to compress voiced speech by extracting parameters that relate to a model of human speech generation are typically called vocoders. Such devices are composed of an encoder, which analyzes the incoming speech to extract the relevant parameters, and a decoder, which resynthesizes the speech using the parameters which it receives over a channel, such as a transmission channel. The speech is divided into blocks of time, or analysis subframes, during which the parameters are calculated. The parameters are then updated for each new subframe.

Linear-prediction-based time domain coders are by far the most popular type of speech coder in use today. These techniques extract the correlation from the input speech samples over a number of past samples and encode only the uncorrelated part of the signal. The basic linear predictive filter used in this technique predicts the current sample as a linear combination of the past samples. An example of a coding algorithm of this particular class is described in the paper "A 4.8 kbps Code Excited Linear Predictive Coder" by Thomas E. Tremain et al., Proceedings of the Mobile Satellite Conference, 1988.

The function of the vocoder is to compress the digitized speech signal into a low bit rate signal by removing all of the natural redundancies inherent in speech. Speech typically has short term redundancies due primarily to the filtering operation of the lips and tongue, and long term redundancies due to the vibration of the vocal cords. In a CELP coder, these operations are modeled by two filters, a short-term formant filter and a long-term pitch filter. Once these redundancies are removed, the resulting residual signal can be modeled as white gaussian noise, which is also encoded.

The basis of this technique is to compute the parameters of two digital filters. One filter, called the formant filter (also known as the "LPC (linear prediction coefficients) filter"), performs short-term prediction of the speech waveform. The other filter, called the pitch filter, performs long-term prediction of the speech waveform. Finally, these filters must be excited, and this is done by determining which one of a number of random excitation waveforms in a codebook results in the closest approximation to the original speech when the waveform excites the two filters mentioned above.

Thus the transmitted parameters relate to three items (1) the LPC filter, (2) the pitch filter and (3) the codebook excitation.

Digital speech coding can be broken in two parts; encoding and decoding, sometimes known as analysis and synthesis. FIG. 1 is a block diagram of a system 100 for digitally encoding, transmitting and decoding speech. The system includes a coder 102, a channel 104, and a decoder 106. Channel 104 can be a communications channel, storage medium, or the like. Coder 102 receives digitized input speech, extracts the parameters describing the features of the speech, and quantizes these parameters into a source bit stream that is sent to channel 104. Decoder 106 receives the bit stream from channel 104 and reconstructs the output speech waveform using the quantized features in the received bit stream.

Many different formats of CELP coding are in use today. In order to successfully decode a CELP-coded speech signal, the decoder 106 must employ the same CELP coding model (also referred to as "format") as the encoder 102 that produced the signal. When communications systems employing different CELP formats must share speech data, it is often desirable to convert the speech signal from one CELP coding format to another.

One conventional approach to this conversion is known as "tandem coding." FIG. 2 is a block diagram of a tandem coding system 200 for converting from an input CELP format to an output CELP format. The system includes an input CELP format decoder 206 and an output CELP format encoder 202. Input format CELP decoder 206 receives a speech signal (referred to hereinafter as the "input" signal) that has been encoded using one CELP format (referred to hereinafter as the "input" format). Decoder 206 decodes the input signal to produce a speech signal. Output CELP format encoder 202 receives the decoded speech signal and encodes it using the output CELP format (referred to hereinafter as the "output" format) to produce an output signal in the output format. The primary disadvantage of this approach is the perceptual degradation experienced by the speech signal in passing through multiple encoders and decoders.

SUMMARY OF THE INVENTION

The present invention is a method and apparatus for CELP-based to CELP-based vocoder packet translation. The apparatus includes a formant parameter translator that translates input formant filter coefficients for a speech packet from an input CELP format to an output CELP format to produce output formant filter coefficients and an excitation parameter translator that translates input pitch and codebook parameters corresponding to the speech packet from the input CELP format to the output CELP format to produce output pitch and codebook parameters. The formant parameter translator includes a model order converter that converts the model order of the input formant filter coefficients from the model order of the input CELP format to the model order of the output CELP format and a time base converter that converts the time base of the input formant filter coefficients from the time base of the input CELP format to the time base of the output CELP format.

The method includes the steps of translating the formant filter coefficients of the input packet from the input CELP format to the output CELP format and translating the pitch and codebook parameters of the input speech packet from the input CELP format to the output CELP format. The step of translating the formant filter coefficients includes the steps of translating the formant filter coefficients from input CELP format to a reflection coefficient CELP format, converting the model order of the reflection coefficients from the model order of the input CELP format to the model order of the output CELP format, translating the resulting coefficients to a line spectral pair (LSP) CELP format, converting the time base of the resulting coefficients from the input CELP format time base to the output CELP format time base, and translate the resulting coefficients from LSP format to the output CELP format to produce output formant filter coefficients. The step of translating the pitch and codebook parameters includes the steps of synthesizing speech using the input pitch and codebook parameters to produce a target signal and searching for the output pitch and codebook parameters using the target signal and the output formant filter coefficients.

An advantage of the present invention is that it eliminates the degradation in perceptual speech quality normally induced by tandem coding translation.

BRIEF DESCRIPTION OF THE FIGURES

The features, objects, and advantages of the present invention will become more apparent from the detailed description set forth below when taken in conjunction with the drawings in which like reference characters identify correspondingly throughout and wherein.

DETAILED DESCRIPTION OF THE PREFERRED EMBODIMENTS

The preferred embodiment of the invention is discussed in detail below. While specific steps, configurations and arrangements are discussed, it should be understood that this is done for illustrative purposes only. A person skilled in the relevant art will recognize that other steps, configurations and arrangements can be used without departing from the spirit and scope of the present invention. The present invention could find use in a variety of information and communication systems, including satellite and terrestrial cellular telephone systems. A preferred application is in CDMA wireless spread spectrum communication systems for telephone service.

The present invention is described in two parts. First, a CELP codec, including a CELP coder and a CELP decoder, is described. Then, a packet translator is described according to a preferred embodiment.

Figure 1:
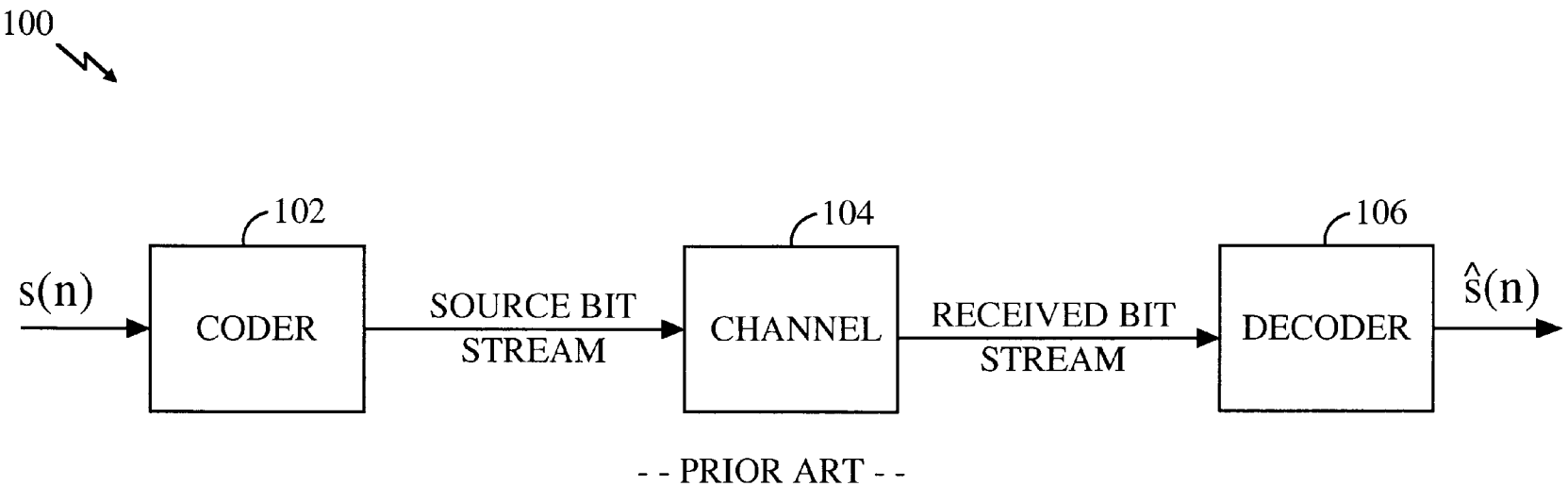
FIG. 1 is a block diagram of a system for digitally encoding, transmitting and decoding speech.
Figure 2:
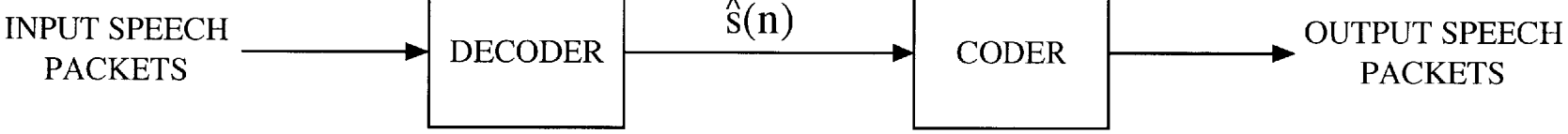
FIG. 2 is a block diagram of a tandem coding system for converting from an input CELP format to an output CELP format.

Before describing a preferred embodiment, an implementation of the exemplary CELP system of FIG. 1 is first described. In this implementation, CELP coder 102 employs an analysis-by-synthesis method to encode a speech signal. According to this method, some of the speech parameters are computed in an open-loop manner, while others are determined in a closed-loop mode by trial and error. Specifically, the LPC coefficients are determined by solving a set of equations. The LPC coefficients are then applied to the formant filter. Then hypothetical values of the remaining parameters (codebook index, codebook gain, pitch lag, and pitch gain) are used with the formant filter to synthesize a speech signal. The synthesized speech signal is then compared to the actual speech signal to determine which of the hypothetical values of the remaining parameters synthesizes the most accurate speech signal.

A Code Excited Linear Predictive (CELP) Decoder

The speech decoding procedure involves unpacking the data packets, unquantizing the received parameters, and reconstructing the speech signal from these parameters. The reconstruction consists of filtering the generated codebook vector using the speech parameters.

Figure 3:
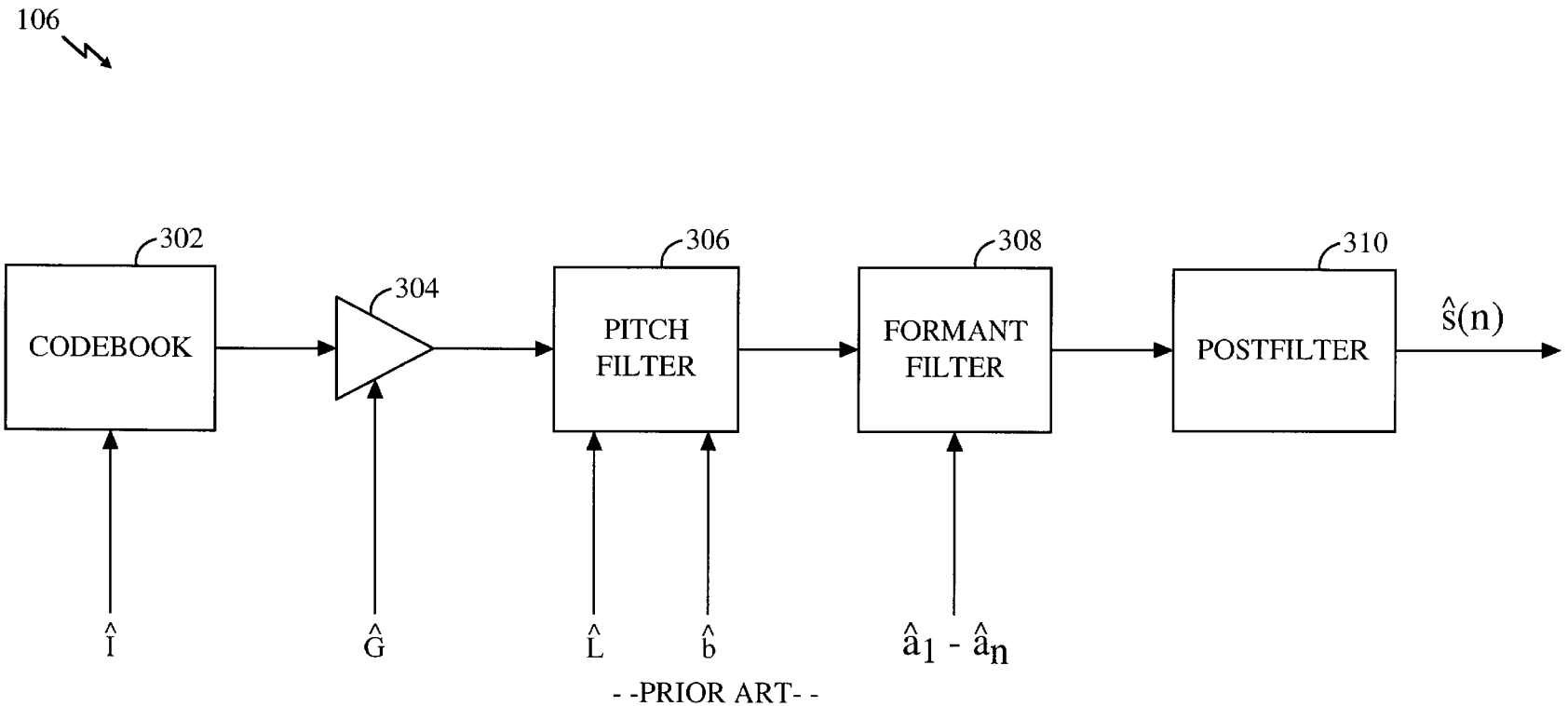
FIG. 3 is a block diagram of a CELP decoder.

FIG. 3 is a block diagram of a CELP decoder 106. CELP decoder 106 includes a codebook 302, a codebook gain element 304, a pitch filter 306, a formant filter 308, and a postfilter 310. The general purpose of each block is summarized below.

Formant filter 308, also referred to as an LPC synthesis filter, can be thought of as modeling the tongue, teeth and lips of the vocal tract, and has resonant frequencies near the resonant frequencies of the original speech caused by the vocal tract filtering. Formant filter 308 is a digital filter of the form $$1/A(z)=1-a_1z^{-1}-\ldots-a_nz^{-n} \quad (1)$$

The coefficients $a_1 \ldots a_n$ of formant filter 308 are referred to as formant filter coefficients or LPC coefficients.

Pitch filter 306 can be thought of as modeling the periodic pulse train coming from the vocal cords during voiced speech. Voiced speech is produced by a complex nonlinear interaction between the vocal cords and outward force of air from the lungs. Examples of voiced sounds are the O in "low" and the A in "day." During unvoiced speech, the pitch filter basically passes the input to the output unchanged. Unvoiced speech is produced by forcing air through a constriction at some point in the vocal tract. Examples of unvoiced sounds are the TH in "these," formed by a constriction between the tongue and upper teeth, and the FF in "shuffle," formed by a constriction between the lower lip and upper teeth. Pitch filter 306 is a digital filter of the form $$1/P(z)=1/(1\bullet b\ z^{-L})=1+b\ z^{-L}+b^2z^{-2L}+\ldots$$

where b is referred to the pitch gain of the filter and L is the pitch lag of the filter.

Codebook 302 can be thought of as modeling the turbulent noise in unvoiced speech and the excitation to the vocal cords in voiced speech. During background noise and silence, the codebook output is replaced by random noise. Codebook 302 stores a number of data words referred to as codebook vectors. Codebook vectors are selected according to a codebook index I. The selected codebook vector is scaled by gain element 304 according to a codebook gain parameter G. Codebook 302 may include gain element 304. The output of the codebook is then also referred to as a codebook vector. Gain element 304 can be implemented, for example, as a multiplier.

Postfilter 310 is used to "shape" the quantization noise added by the parameter quantization and imperfections in the codebook. This noise can be noticeable in frequency bands which have little signal energy, yet might be imperceptible in frequency bands which have large signal energy. To take advantage of this property, postfilter 310 attempts to put more quantization noise into perceptually insignificant frequency ranges, and less noise into perceptually significant frequency ranges. This postfiltering is discussed further in J-H. Chen & A. Gersho, "Real-Time Vector APC Speech Coding at 4800 bps with Adaptive Postfiltering," in Proc. ICASSP (1987) and N. S. Jayant & V. Ramamoorthy, "Adaptive Postfiltering of Speech," in Proc. ICASSP 829-32 (Tokyo, Japan, Apr. 1986).

In one embodiment, each frame of digitized speech contains one or more subframes. For each subframe, a set of speech parameters is applied to CELP decoder 106 to generate one subframe of synthesized speech •(n). The speech parameters include codebook index I, codebook gain G, pitch lag L, pitch gain b, and formant filter coefficients $a_1 \ldots a_n$. One vector of codebook 302 is selected according to index I, scaled according to gain G, and used to excite pitch filter 306 and formant filter 308. Pitch filter 306 operates on the selected codebook vector according to pitch gain b and pitch lag L. Formant filter 308 operates on the signal generated by pitch filter 306 according to formant filter coefficients $a_1 \ldots a_n$ to produce synthesized speech signal •(n).

A Code Excited Linear Predictive (CELP) Coder

The CELP speech encoding procedure involves determining the input parameters for the decoder which minimize the perceptual difference between a synthesized speech signal and the input digitized speech signal. The selection processes for each set of parameters are described in the following subsections. The encoding procedure also includes quantizing the parameters and packing them into data packets for transmission, as would be apparent to one skilled in the relevant arts.

Figure 4:
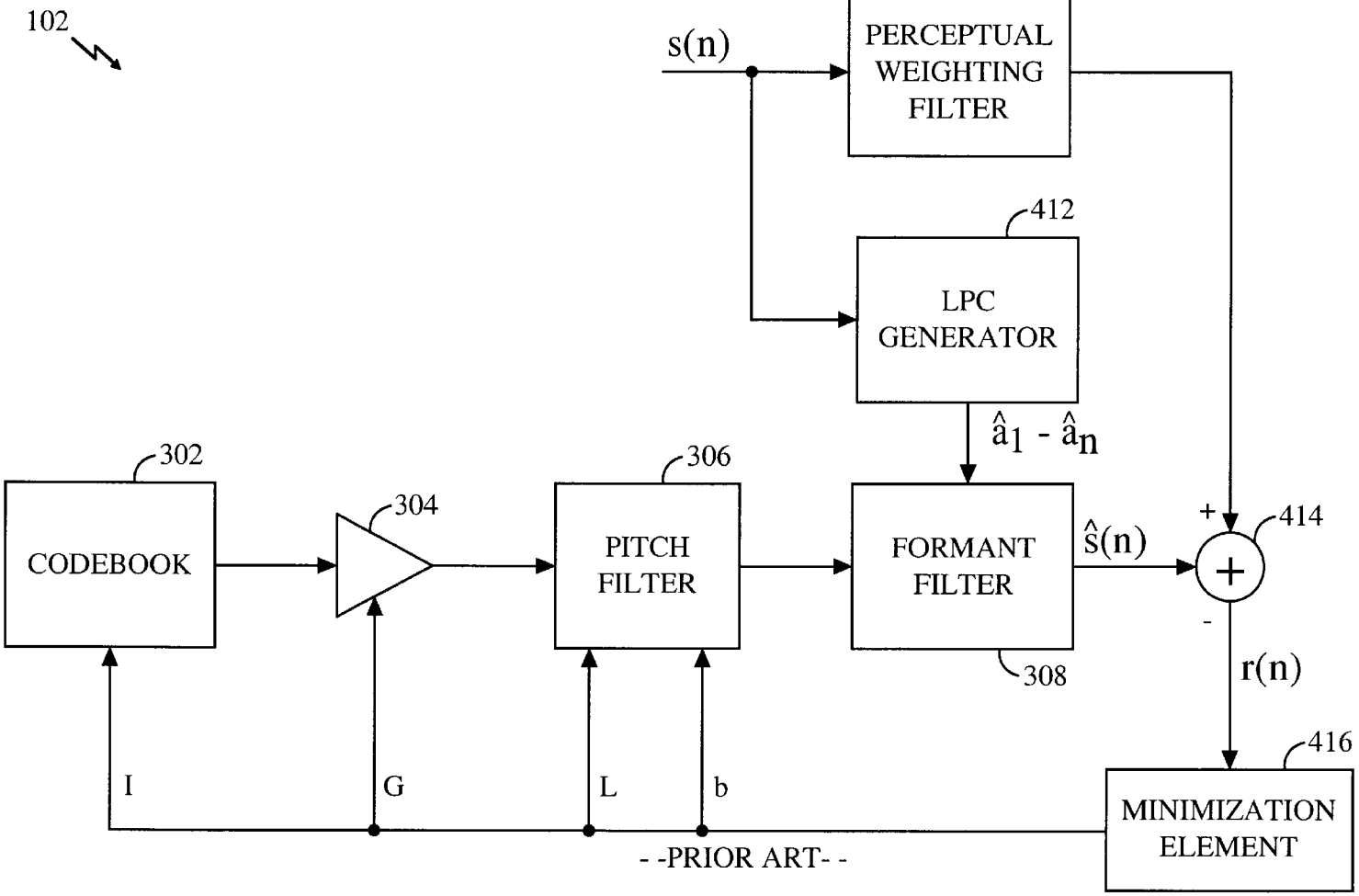
FIG. 4 is a block diagram of a CELP coder.

FIG. 4 is a block diagram of a CELP coder 102. CELP coder 102 includes a codebook 302, a codebook gain element 304, a pitch filter 306, a formant filter 308, a perceptual weighting filter 410, an LPC generator 412, a summer 414, and a minimization element 416. CELP coder 102 receives a digital speech signal s(n) that is partitioned into a number of frames and subframes. For each subframe, CELP coder 102 generates a set of parameters that describe the speech signal in that subframe. These parameters are quantized and transmitted to a CELP decoder 106. CELP decoder 106 uses these parameters to synthesize the speech signal, as described above.

Referring to FIG. 4, the generation of LPC coefficients is performed in an open-loop mode. From each subframe of input speech samples s(n) LPC generator 412 computes LPC coefficients by methods well-known in the relevant art. These LPC coefficients are fed to formant filter 308.

The computation of the pitch parameters b and L and codebook parameters I and G however, is performed in a closed-loop mode, often referred to as an analysis-by-synthesis method. According to this method, various hypothetical candidate values of codebook and pitch parameters are applied to a CELP coder to synthesize a speech signal •(n). The synthesized speech signal •(n) for each guess, i.e., prediction, is compared to the input speech signal s(n) at summer 414. The error signal r(n) that results from this comparison is provided to minimization element 416. Minimization element 416 selects different combinations of guess codebook and pitch parameters and determines the combination that minimizes error signal r(n). These parameters, and the formant filter coefficients generated by LPC generator 412, are quantized and packetized for transmission.

In the embodiment depicted in FIG. 4, the input speech samples s(n) are weighted by perceptual weighting filter 410 so that the weighted speech samples are provided to sum input of adder 414. Perceptual weighting is utilized to weight the error at the frequencies where there is less signal power. It is at these low signal power frequencies that the noise is more perceptually noticeable. This perceptual weighting is further discussed in U.S. Pat. No. 5,414,796 entitled "Variable Rate Vocoder," which is incorporated by reference herein in its entirety.

Minimization element 416 conducts the search for the codebook and pitch parameters in two stages. First, minimization element 416 searches for the pitch parameters. During the pitch search there is no contribution from the codebook (G=0). In minimization element 416 all possible values for the pitch lag parameter L and the pitch gain parameter b are input to pitch filter 306. Minimization element 416 chooses the values of L and b that minimize the error r(n) between the weighted input speech and the synthesized speech.

Once the pitch lag L and the pitch gain b for the pitch filter are found, the codebook search is performed in a similar manner. Minimization element 416 then generates values for codebook index I and codebook gain G. The output values from codebook 302, selected according to the codebook index I, are multiplied in gain element 304 by the codebook gain G to produce the sequence of values used in pitch filter 306. Minimization element 416 chooses the codebook index I and the codebook gain G that minimize the error r(n).

In one embodiment, perceptual weighting is applied to both the input speech by perceptual weighting filter 410 and the synthesized speech by a weighting function incorporated within formant filter 308. In an alternative embodiment, perceptual weighting filter 410 may be placed after adder 414.

CELP-based to CELP-based Vocoder Packet Translation

In the following discussion, the speech packet to be translated is referred to as the "input" packet having an "input" CELP format that specifies "input" codebook and pitch parameters and "input" formant filter coefficients. Likewise, the result of the translation is referred to as the "output" packet having an "output" CELP format that specifies "output" codebook and pitch parameters and "output" formant filter coefficients. One useful application of such a translation is to interface a wireless telephone system to the internet for exchanging speech signals.

Figure 5:
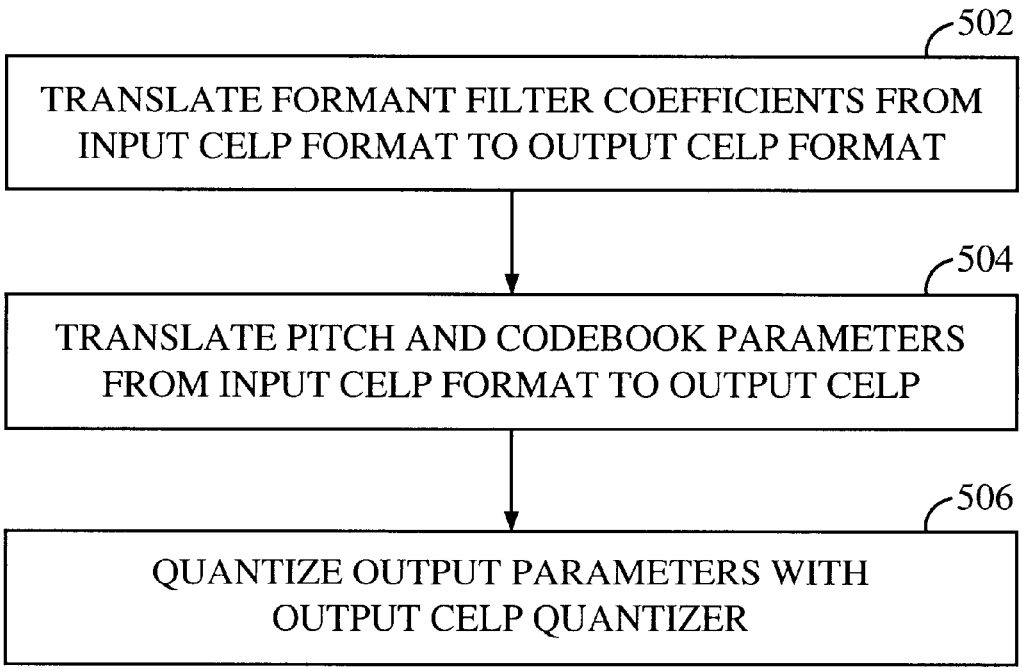
FIG. 5 is a flowchart depicting a method for CELP-based to CELP-based vocoder packet translation according to an embodiment of the present invention.

FIG. 5 is a flowchart depicting the method according to a preferred embodiment. The translation proceeds in three stages. In the first stage, the formant filter coefficients of the input speech packet are translated from the input CELP format to the output CELP format, as shown in step 502. In the second stage, the pitch and codebook parameters of the input speech packet are translated from the input CELP format to the output CELP format, as shown in step 504. In the third stage, the output parameters are quantized with the output CELP quantizer as shown in step 506.

Figure 6:
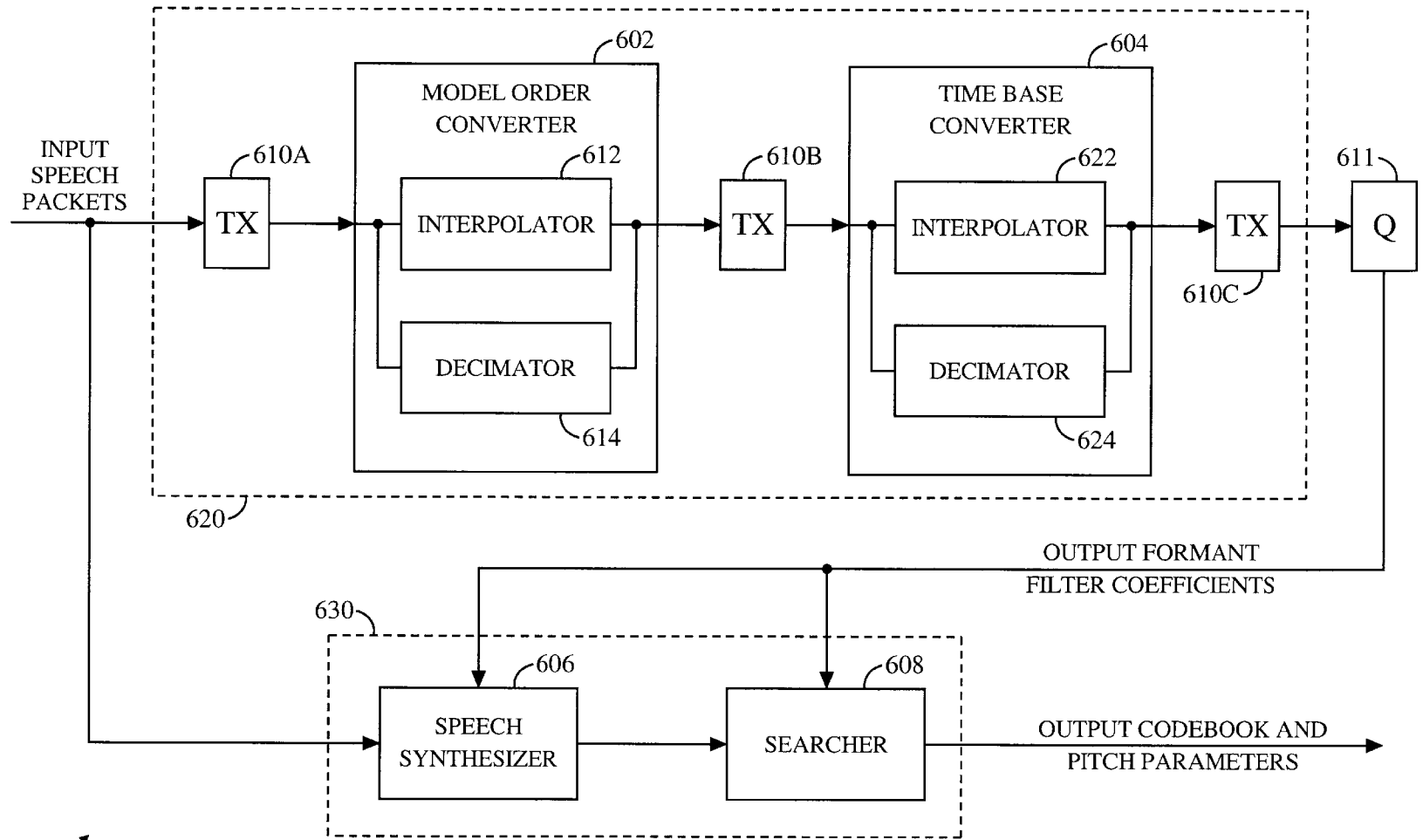
FIG. 6 depicts a CELP-based to CELP-based vocoder packet translator according to an embodiment of the present invention.
Figure 7:
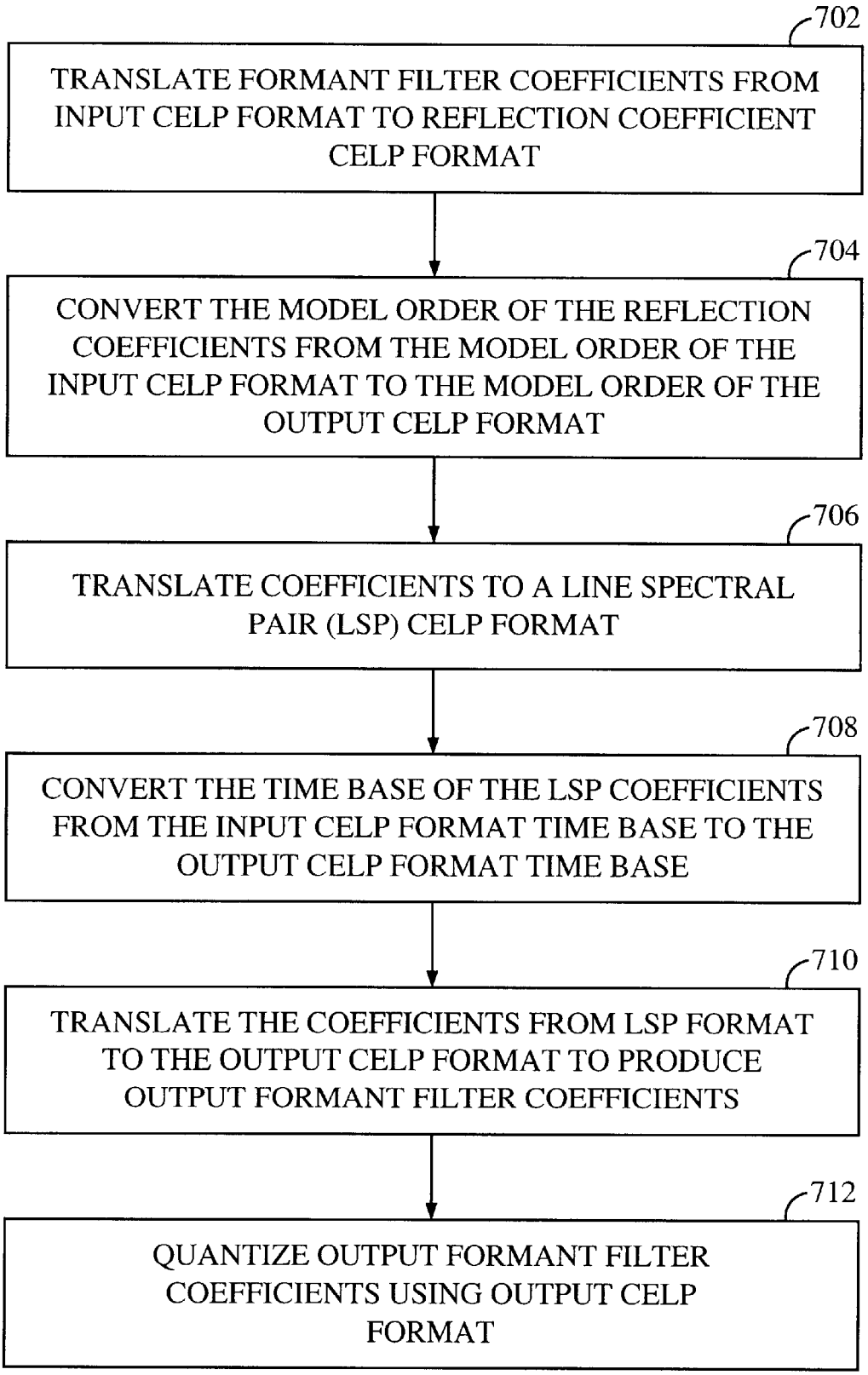
FIGS. 7, 8, and 9 are flowcharts depicting the operation of a formant parameter translator according to an embodiment of the present invention.
Figure 8:
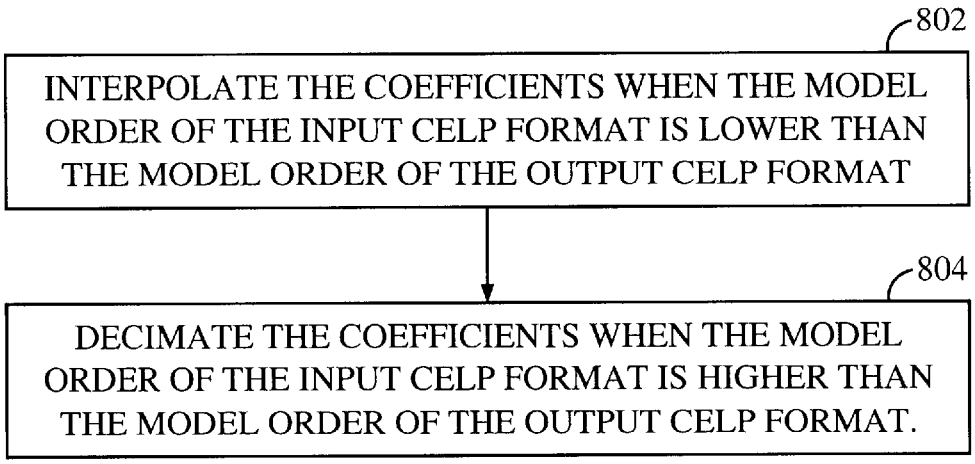
Figure 9:
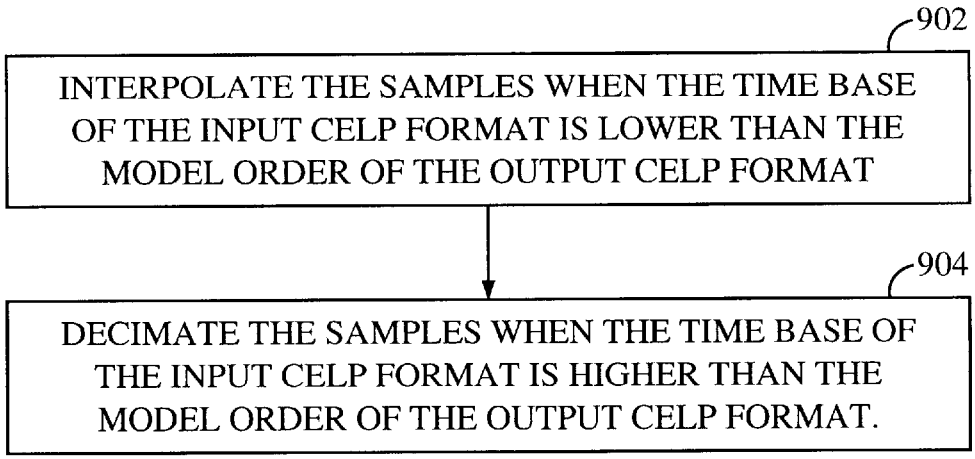

FIG. 6 depicts a packet translator 600 according to a preferred embodiment. Packet translator 600 includes a formant parameter translator 620 and an excitation parameter translator 630. Formant parameter translator 620 translates the input formant filter coefficients to the output CELP format to produce output formant filter coefficients. Formant parameter translator 620 includes a model order converter 602, a time base converter 604, and formant filter coefficient translators 610A,B,C. Excitation parameter translator 630 translates the input pitch and codebook parameters to the output CELP format to produce output pitch and codebook parameters. Excitation parameter translator 630 includes a speech synthesizer 606 and a searcher 608. FIGS. 7, 8 and 9 are flowcharts depicting the operation of formant parameter translator 620 according to a preferred embodiment.

Input speech packets are received by translator 610A. Translator 610A translates the formant filter coefficients of each input speech packet from the input CELP format to a CELP format suitable for model order conversion. The model order of a CELP format describes the number of formant filter coefficients employed by the format. In a preferred embodiment, the input formant filter coefficients are translated to reflection coefficient format, as shown in step 702. The model order of the reflection coefficient format is chosen to be the same as the model order of the input formant filter coefficient format. Methods for performing such a translation are well-known in the relevant art. Of course, if the input CELP format employs reflection coefficient format formant filter coefficients, this translation is unnecessary.

Model order converter 602 receives the reflection coefficients from translator 610A and converts the model order of the reflection coefficients from the model order of the input CELP format to the model order of the output CELP format, as shown in step 704. Model order converter 602 includes an interpolator 612 and a decimator 614. When the model order of the input CELP format is lower than the model order of the output CELP format, interpolator 612 performs an interpolation operation to provide additional coefficients, as shown in step 802. In one embodiment, additional coefficients are set to zero. When the model order of the input CELP format is higher than the model order of the output CELP format, decimator 614 performs a decimation operation to reduce the number of coefficients, as shown in step 804. In one embodiment, the unnecessary coefficients are simply replaced by zeroes. Such interpolation and decimation operations are well-known in the relevant arts. In the coefficient reflection domain model, order conversion is relatively simple, making it a likely choice. Of course, if the model orders of the input and output CELP formats are the same, model order conversion is unnecessary.

Translator 610B receives the order-corrected formant filter coefficients from model order converter 602 and translates the coefficients from the reflection coefficient format to a CELP format suitable for time base conversion. The time base of a CELP format describes the rate at which the formant synthesis parameters are sampled, i.e., the number of vectors per second of formant synthesis parameters. In a preferred embodiment, the reflection coefficients are translated to line spectral pair (LSP) format, as shown in step 706. Methods for performing such a translation are well-known in the relevant art.

Time base converter 604 receives the LSP coefficients from translator 610B and converts the time base of the LSP coefficients from the time base of the input CELP format to the time base of the output CELP format, as shown in step 708. Time base converter 604 includes an interpolator 622 and a decimator 624. When the time base of the input CELP format is lower than the time base of the output CELP format (i.e., uses fewer samples per second), interpolator 622 performs an interpolation operation to increase the number of samples, as shown in step 902. When the time base of the input CELP format is higher than the model order of the output CELP format (i.e., uses more samples per second), decimator 624 performs a decimation operation to reduce the number of samples, as shown in step 904. Such interpolation and decimation operations are well-known in the relevant arts. Of course, if the time base of the input CELP format is the same as the time base of the output CELP format, no time base conversion is necessary.

Translator 610C receives the time-base-corrected formant filter coefficients from time base converter 604 and translates the coefficients from the LSP format to the output CELP format to produce output formant filter coefficients, as shown in step 710. Of course, if the output CELP format employs LSP format formant filter coefficients, this translation is unnecessary. Quantizer 611 receives the output formant filter coefficients from translator 610C and quantizes the output formant filter coefficients, as shown in step 712.

Figure 10:
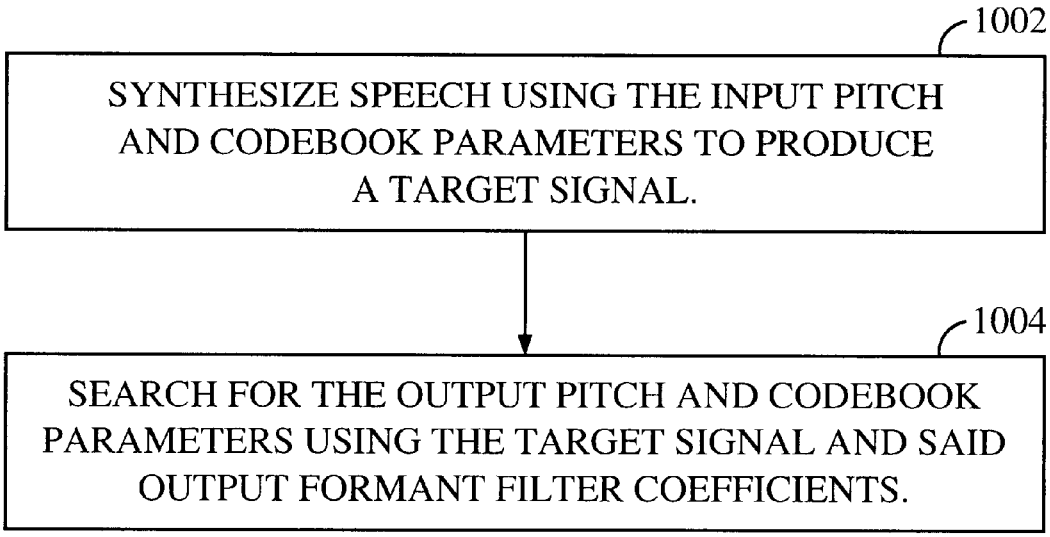
FIG. 10 is a flowchart depicting the operation of an excitation parameter translator according to an embodiment of the present invention.

In the second stage of translation, the pitch and codebook parameters (also referred to as "excitation" parameters) of the input speech packet are translated from the input CELP format to the output CELP format, as shown in step 504. FIG. 10 is a flowchart depicting the operation of excitation parameter translator 630 according to a preferred embodiment of the present invention.

Referring to FIG. 6, speech synthesizer 606 receives the pitch and codebook parameters of each input speech packet. Speech synthesizer 606 generates a speech signal, referred to as the "target signal," using the output formant filter coefficients, which were generated by formant parameter translator 620, and the input codebook and pitch excitation parameters, as shown in step 1002. Then in step 1004, searcher 608 obtains the output codebook and pitch parameters using a search routine similar to that used by CELP decoder 106, described above. Searcher 608 then quantizes the output parameters.

Figure 11:
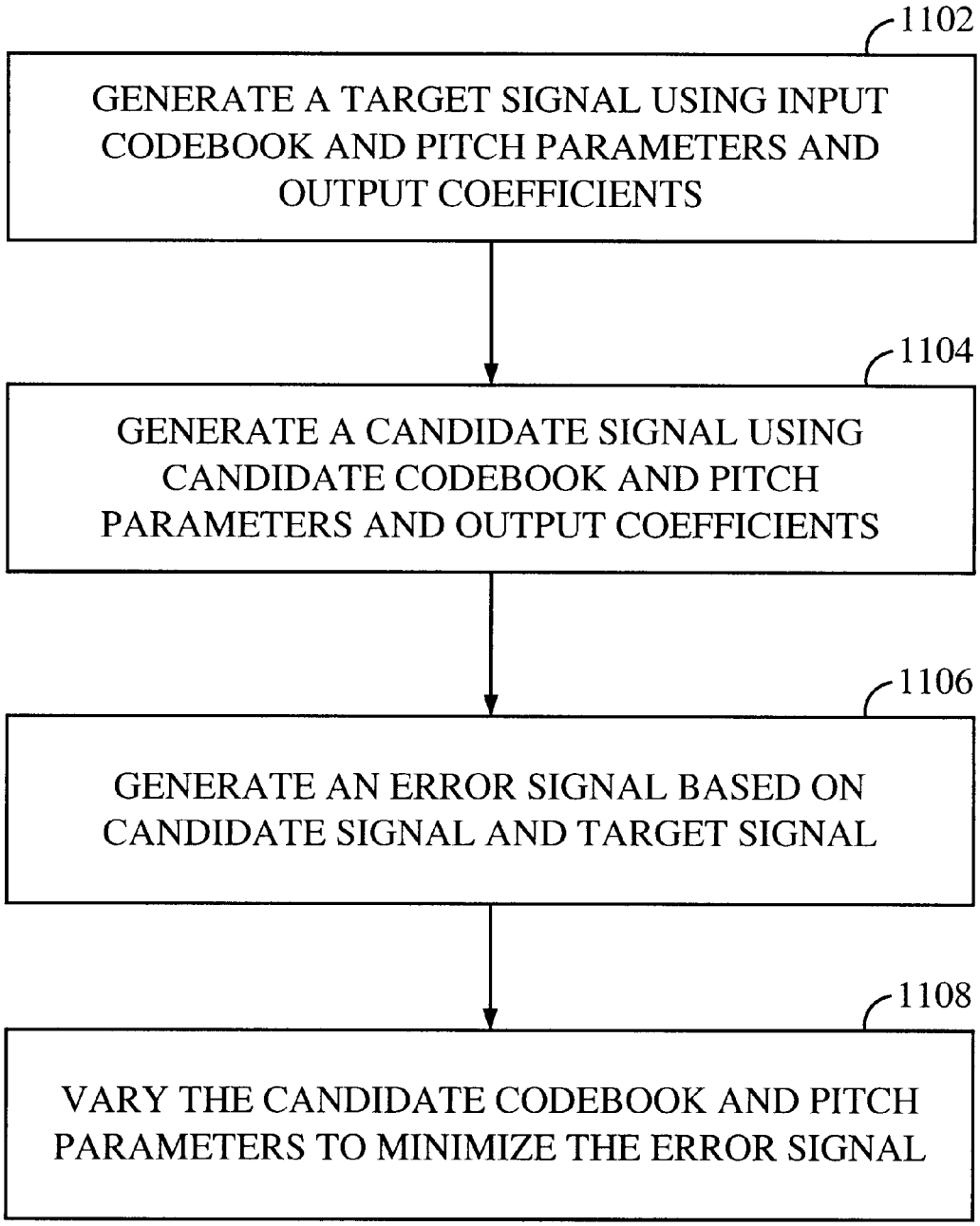
FIG. 11 is a flowchart depicting the operation of a searcher.

FIG. 11 is a flowchart depicting the operation of searcher 608 according to a preferred embodiment of the present invention. At step 1102, the process generates a target signal using input codebook and pitch parameters and output coefficients. In this search, searcher 608 uses the output formant filter coefficients generated by formant parameter translator 620 and the target signal generated by speech synthesizer 606 and candidate codebook and pitch parameters to generate a candidate signal, as shown in step 1104. Searcher 608 compares the target signal and the candidate signal to generate an error signal, as shown in step 1106. Searcher 608 then varies the candidate codebook and pitch parameters to minimize the error signal, as shown in step 1108. The combination of pitch and codebook parameters that minimizes the error signal is selected as the output excitation parameters. These processes are described in greater detail below.

Figure 12:
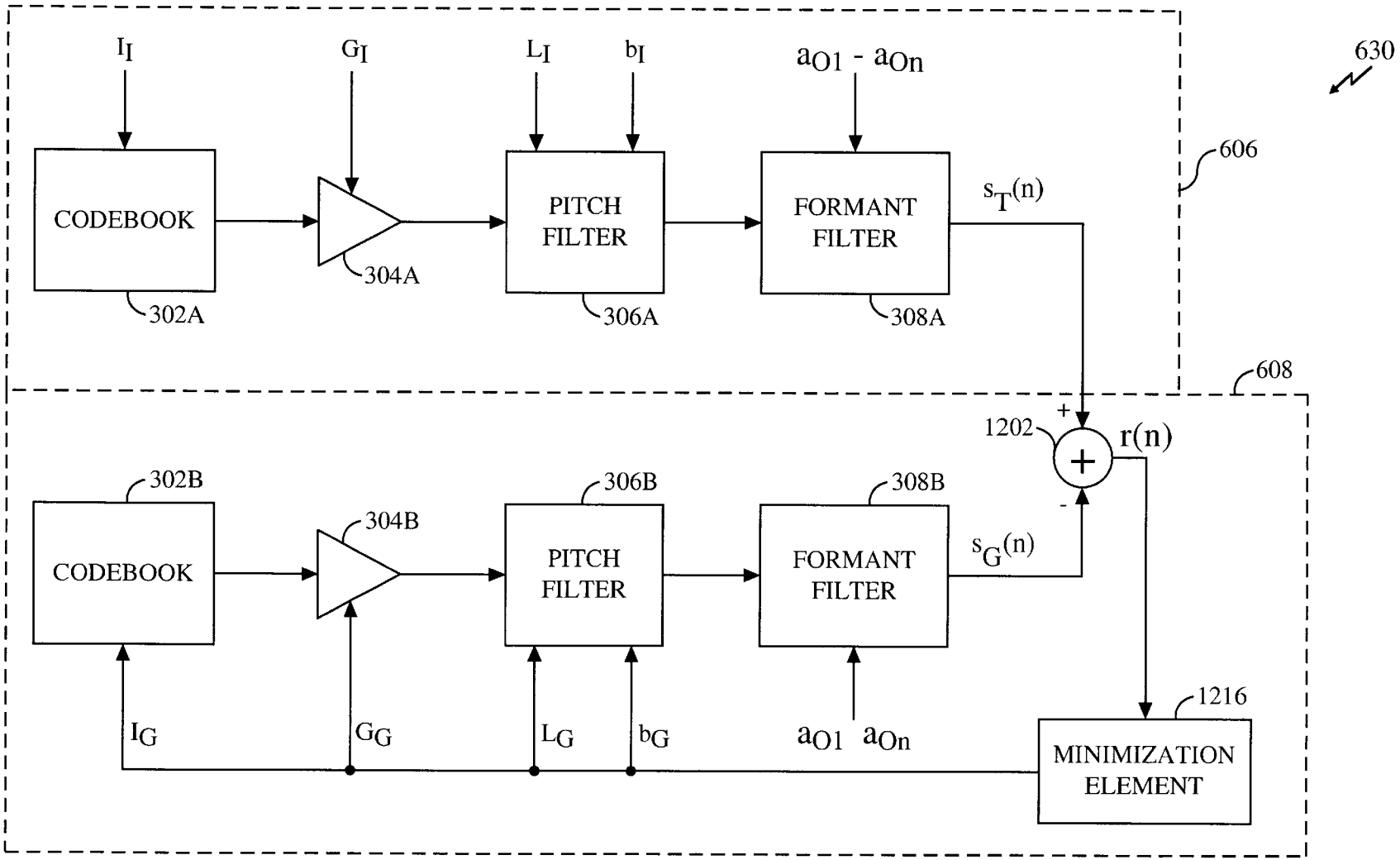
FIG. 12 depicts an excitation parameter translator in greater detail.

FIG. 12 depicts excitation parameter translator 630 in greater detail. As described above, excitation parameter translator 630 includes a speech synthesizer 606 and a searcher 608. Referring to FIG. 12, speech synthesizer 606 includes a codebook 302A, a gain element 304A, a pitch filter 306A, and a formant filter 308A. Speech synthesizer 606 produces a speech signal based on excitation parameters and formant filter coefficients, as described above for decoder 106. Specifically, speech synthesizer 606 generates a target signal $S_T(n)$ using the input excitation parameters and the output formant filter coefficients. Input codebook index $I_I$ is applied to codebook 302A to generate a codebook vector. The codebook vector is scaled by gain element 304A using input codebook gain parameter $G_I$. Pitch filter 306A generates a pitch signal using the scaled codebook vector and input pitch gain and pitch lag parameters $b_I$ and $L_I$. Formant filter 308A generates target signal $S_I(n)$ using the pitch signal and the output formant filter coefficients $a_{o1} \ldots a_{on}$ generated by formant parameter translator 620. Those of skill would appreciate that the time base of the input and output excitation parameters can be different, but the excitation signal produced is of the same time base (8000 excitation samples per second, in accordance with one embodiment). Thus, time base interpolation of excitation parameters is inherent in the process.

Searcher 608 includes a second speech synthesizer, a summer 1202, and a minimization element 1216. The second speech synthesizer includes a codebook 302B, a gain element 304B, a pitch filter 306B, and a formant filter 308B. The second speech synthesizer produces a speech signal based on excitation parameters and formant filter coefficients, as described above for decoder 106.

Specifically, speech synthesizer 606 generates a candidate signal $s_G(n)$ using candidate excitation parameters and the output formant filter coefficients generated by formant parameter translator 620. Guess codebook index $I_G$ is applied to codebook 302B to generate a codebook vector. The codebook vector is scaled by gain element 304B using input codebook gain parameter $G_G$. Pitch filter 306B generates a pitch signal using the scaled codebook vector and input pitch gain and pitch lag parameters $b_G$ and $L_G$. Formant filter 308B generates guess signal $s_G(n)$ using the pitch signal and the output formant filter coefficients $a_{o1} \ldots a_{on}$.

Searcher 608 compares the candidate and target signals to generate an error signal r(n). In a preferred embodiment, target signal $s_I(n)$ is applied to a sum input of a summer 1202, and guess signal $s_G(n)$ is applied to a difference input of summer 1202. The output of summer 1202 is the error signal r(n).

Error signal r(n) is provided to a minimization element 1216. Minimization element 1216 selects different combinations of codebook and pitch parameters and determines the combination that minimizes error signal r(n) in a manner similar to that described above with respect to minimization element 416 of CELP coder 102. The codebook and pitch parameters that result from this search are quantized and used with the formant filter coefficients that are generated and quantized by the formant parameter translator of packet translator 600 to produce a packet of speech in the output CELP format.

Conclusion

The foregoing description of the preferred embodiments is provided to enable any person skilled in the art to make or use the present invention. The various modifications to these embodiments will be readily apparent to those skilled in the art, and the generic principles defined herein may be applied to other embodiments without the use of the inventive faculty. Thus, the present invention is not intended to be limited to the embodiments shown herein but is to be accorded the widest scope consistent with the principles and novel features disclosed herein.

What is claimed is:

1. An apparatus for converting a compressed speech packet from one code excited linear prediction (CELP) format to another, comprising:

a formant parameter translator that translates input formant filter coefficients having an input CELP format and corresponding to a speech packet to an output CELP format to produce output formant filter coefficients; and an excitation parameter translator that translates input pitch and codebook parameters having an input CELP format and corresponding to said speech packet to said output CELP format to produce output pitch and codebook parameters, wherein said excitation parameter translator comprises:

a model order converter that converts the model order of said input formant filter coefficients from a model order of said input CELP format to a model order of said output CELP format;

a time base converter that converts the time base of said input formant filter coefficients from a time base of said input CELP format to a time base of said output CELP format;

a speech synthesizer that produces a target signal using said input pitch and codebook parameters and said output formant filter coefficients; and a searcher that searches for said output codebook and pitch parameters using said target signal and said output formant filter coefficients.

2. The apparatus of claim 1, wherein said formant parameter translator comprises:

a model order converter that converts the model order of said input formant filter coefficients from a model order of said input CELP format to a model order of said output CELP format; and a time base converter that converts the time base of said input formant filter coefficients from a time base of said input CELP format to a time base of said output CELP format.

3. The apparatus of claim 1, wherein said searcher comprises:

a further speech synthesizer that generates a guess signal using guess excitation parameters and said output formant filter coefficients;

a combiner that generates an error signal based on said guess signal and said target signal; and a minimization element that varies said guess excitation parameters to minimize said error signal.

4. The apparatus of claim 1, wherein said model order converter further comprises:

a formant filter coefficient translator that translates said input formant filter coefficients to a third CELP format prior to use by said speech synthesizer to produce third coefficients.

5. The apparatus of claim 4, wherein said model order converter further comprises:

an interpolator that interpolates said third coefficients to produce order corrected coefficients when said model order of said input CELP format is lower than said model order of said output CELP format; and a decimator that decimates said third coefficients to produce said order corrected coefficients when said model order of said input CELP format is higher than said model order of said output CELP format.

6. The apparatus of claim 1, wherein said speech synthesizer comprises:

a codebook using said input codebook parameters to produce a codebook vector;

a pitch filter using said input pitch filter parameters and said codebook vector to produce a pitch signal; and a formant filter using said output formant filter coefficients and said pitch signal to produce said target signal.

7. The apparatus of claim 6, wherein said guess excitation parameters include guess pitch filter parameters and guess codebook parameters, wherein said further speech synthesizer comprises:

a further codebook using said guess codebook parameters to produce a further codebook vector;

a pitch filter using said guess pitch filter parameters and said further codebook vector to produce a further pitch signal; and a formant filter using said output formant filter coefficients and said further pitch signal to produce said guess signal.

8. The apparatus of claim 2, further comprising:

a first formant filter coefficient translator that translates said input formant filter coefficients to a fourth CELP format before use by said time base converter.

9. The apparatus of claim 2, further comprising:

a second formant filter coefficient translator that translates the output of said time base converter from said fourth CELP format to said output CELP format.

10. The apparatus of claim 4, wherein said third CELP format is a reflection coefficient CELP format.

11. The apparatus of claim 8, wherein said fourth CELP format is a line spectral pair CELP format.

12. A method for converting a compressed speech packet from one CELP format to another, comprising the steps of:

(a) translating input formant filter coefficients corresponding to a speech packet from an input CELP format to an output CELP format to produce output formant filter coefficients; and (b) translating input pitch and codebook parameters corresponding to said speech packet from said input CELP format to said output CELP format to produce output pitch and codebook parameters, comprising:

(i) synthesizing speech using said input pitch and codebook parameters in said input CELP format and said output formant filter coefficients to produce a target signal; and (ii) searching for said output pitch and codebook parameters using said target signal and said output formant filter coefficients.

13. The method of claim 12, wherein step (a) comprises the steps of:

(i) converting the model order of said input formant filter coefficients from a model order of said input CELP format to a model order of said output CELP format; and (ii) converting the time base of said input formant filter coefficients from a time base of said input CELP format to a time base of said output CELP format.

14. The method of claim 13, wherein step (i) comprises the steps of:

translating said input formant filter coefficients from said input CELP format to a third CELP format to produce third coefficients; and converting the model order of said third coefficients from a model order of said input CELP format to a model order of said output CELP format to produce order corrected coefficients.

15. The method of claim 14, wherein step (ii) comprises the steps of:

translating said order corrected coefficients t o a fourth format to produce fourth coefficients;

converting the time base of said fourth coefficients form a time base of said input CELP format to a time base of said output CELP format to produce time base corrected coefficients; and translating said time base corrected coefficients from said fourth format to said output CELP format to produce said output formant filter coefficients.

16. The method of claim 12, wherein said searching step (ii) comprises the steps of:

generating a guess signal using guess codebook and pitch parameters and said output coefficients;

generating an error signal based on said guess signal and said target signal; and varying said guess codebook and pitch parameters to minimize said error signal.

17. The method of claim 14, wherein step (i) further comprises the steps of:

interpolating said third coefficients to produce said order corrected coefficients when said model order of said input CELP format is lower than said model order of said output CELP format; and decimating said third coefficients to produce said order corrected coefficients when said model order of said input CELP format is higher than said model order of said output CELP format.

18. The method of claim 14, wherein said third CELP format is a reflection coefficient CELP format.

19. The method of claim 15, wherein said fourth CELP format is a line spectral pair CELP format.

* * * * *